US008905338B2

(12) United States Patent
Robinson et al.

(10) Patent No.: US 8,905,338 B2
(45) Date of Patent: Dec. 9, 2014

(54) CRUSHING MACHINES

(71) Applicant: Terex GB Ltd., Dungannon (GB)

(72) Inventors: Karl Robinson, Ballygawley (IE); Jonathan Nevin, Omagh (IE); Anthony Devlin, Dungannon (IE)

(73) Assignee: Terex GB Limited, Dungannon, Co. Tyrone (GB)

( * ) Notice: Subject to any disclaimer, the term of this patent is extended or adjusted under 35 U.S.C. 154(b) by 0 days.

(21) Appl. No.: 13/740,708

(22) Filed: Jan. 14, 2013

(65) Prior Publication Data

US 2013/0126648 A1 May 23, 2013

Related U.S. Application Data

(62) Division of application No. 12/596,943, filed as application No. PCT/GB2008/001396 on Apr. 21, 2008, now Pat. No. 8,469,298.

(30) Foreign Application Priority Data

Apr. 21, 2007 (GB) ..... 0707761.3

(51) Int. Cl.

| | |
|---|---|
| ***B02C 23/02*** | (2006.01) |
| ***B02C 2/00*** | (2006.01) |
| ***B02C 23/04*** | (2006.01) |
| ***B02C 23/08*** | (2006.01) |
| ***B02C 21/02*** | (2006.01) |

(52) U.S. Cl.

CPC ..... *B02C 2/007* (2013.01); *B02C 23/04* (2013.01); *B02C 23/08* (2013.01); *B02C 23/02* (2013.01); *B02C 21/026* (2013.01)

USPC ..... 241/34; 241/81; 241/101.5

(58) Field of Classification Search

USPC ..... 241/81, 101.5, 34

See application file for complete search history.

(56) References Cited

U.S. PATENT DOCUMENTS

| | | | | |
|---|---|---|---|---|
| 3,647,150 | A | 3/1972 | Stephanek | |
| 3,963,181 | A | 6/1976 | Deloy et al. | |
| 4,478,372 | A * | 10/1984 | Paterson et al. | 241/35 |

(Continued)

FOREIGN PATENT DOCUMENTS

| | | | |
|---|---|---|---|
| EP | 0382922 | A2 | 8/1990 |
| WO | 2005099903 | A1 | 10/2005 |

OTHER PUBLICATIONS

International Search Report for PCT/GB2008/001396; Dated Apr. 21, 2008—(15 Pages).

(Continued)

*Primary Examiner* — Mark Rosenbaum

(74) *Attorney, Agent, or Firm* — Boyle Fredrickson, S.C.

(57) ABSTRACT

A crushing machine including a crushing means, a feed conveyor for feeding material to the crushing means, a detector for detecting metal in the material on the feed conveyor, and a bypass chute for the crushing means, the feed conveyor being movable between a normal operating position in which the material is fed to the crushing means and a bypass position in which the material is fed to the bypass chute, the arrangement being such that on detection of metal in the material, the feed conveyor is stopped and moved from the normal operating position to the bypass position so that the material with the metal is discharged into the bypass chute.

11 Claims, 3 Drawing Sheets

(56) References Cited

U.S. PATENT DOCUMENTS

| | | | | |
|---|---|---|---|---|
| 4,598,875 | A | 7/1986 | Bronson et al. | |
| 4,655,402 | A | 4/1987 | Desourdy | |
| 5,074,435 | A | 12/1991 | Suverkrop et al. | |
| 5,263,651 | A * | 11/1993 | Nadarajah | 241/28 |
| 7,004,411 | B2 | 2/2006 | Nuora et al. | |
| 2002/0044828 | A1 | 4/2002 | Olynyk | |
| 2004/0035963 | A1 | 2/2004 | Nuora et al. | |
| 2008/0245915 | A1 | 10/2008 | Douglas et al. | |

OTHER PUBLICATIONS

IP Australia Examiner's report No. 2 dated Sep. 5, 2011 for patent application No. 2008240460—(2 Pages).

Extended European Search Report dated Feb. 2, 2014; Application No. 14152199.7—(6) Pages.

* cited by examiner

CRUSHING MACHINES

CROSS-REFERENCE TO RELATED APPLICATIONS

This application is a divisional application and claims priority to U.S. Pat. No. 8,469,298 filed on Mar. 31, 2010 titled "Crushing Machines", which is a U.S. National Stage filing under 35 U.S.C. §371 of International Application No. PCT/GB2008/01396 filed on Apr. 21, 2008, which claims priority to United Kingdom Patent Application No 0707761.3 filed on Apr. 21, 2007, the disclosures of each of which are incorporated herein.

BACKGROUND OF THE INVENTION

This invention relates to crushing machines for crushing aggregate and the like; and in particular to mobile crushing machines such as are used in quarries or for recycling demolition waste.

One type of crushing machine uses a crusher. A cone crusher has a pair of frusta-conical members arranged with their apexes upwards, and with an annular gap between them that decreases in width from top to bottom. The inner cone is rotatable relative to the outer cone on an eccentric, so that material fed in at the top is crushed between the cones as the gap varies, and then falls out at the bottom. Cone crushers are efficient at crushing various types of material, such as rock or stone, to a given size. However, it is important to ensure that no metal is fed into the crusher, since this can cause extensive damage to the cones. It is known to address this problem by providing a metal detector on a conveyor feeding the material to the crusher, so that the machine operator can then stop the conveyor, find the metal in the material by hand, remove it and then restart the conveyor. This is time-consuming, and not a pleasant task for the operator.

SUMMARY OF THE INVENTION

According to a first aspect of the invention, we provide a crushing machine including a crushing means, a feed conveyor for feeding material to the crushing means, a detector for detecting metal in the material on the feed conveyor, and a bypass chute for the crushing means, the feed conveyor being movable between a normal operating position in which the material is fed to the crushing means and a bypass position in which the material is fed to the bypass chute, the arrangement being such that on detection of metal in the material the feed conveyor is stopped and moved from the normal operating position to the bypass position so that the material with the metal is discharged into the bypass chute.

The invention therefore provides a much easier and quicker way of removing metal from the material before it reaches the crushing means, since on detection of metal the conveyor can simply be stopped, and moved into the bypass position to discharge the metal into the bypass chute without the operator needing to look for the metal and remove it manually. It is particularly advantageous where the crushing means is a cone crusher, but may also be useful for other types of crusher.

Once the material containing the metal has been discharged into the bypass chute, the feed conveyor is stopped again, moved back into the normal operating position and started, to resume discharge into the crushing means.

The metal detector is preferably mounted on the feed conveyor, and sends a signal to the operator when metal is detected.

The feed conveyor may be movable between the two positions by means of at least one hydraulic piston and cylinder assembly. The or each piston and cylinder assembly is conveniently double-acting. The piston may be connected to the feed conveyor, and the cylinder to a stationary part of the machine, although the opposite way round would also be possible. The piston and cylinder assembly or assemblies moves the feed conveyor longitudinally. The bypass chute is preferably arranged between the feed conveyor and the crushing means, so that the feed conveyor moves rearwardly (opposite to the direction of travel of the material) from its normal operating position into its bypass position. The piston of the piston and cylinder assembly will be extended when the conveyor is in its normal operating position, and retracted when it is in its bypass position. The piston and cylinder assembly may have load-holding valves to lock the piston in position.

The crushed material which exits the crushing means may fall onto a main conveyor for transport elsewhere. The material discharged into the bypass chute will be diverted away from the crushed material. It may simply fall to the ground, or into a convenient container.

The invention is particularly useful where the crushing machine is a mobile crusher, having a tracked or wheeled base on which are mounted the feed conveyor, the bypass chute, the crushing means, the main conveyor, a power unit (typically a diesel engine) and a control system (including both manual and electronic controls).

The control system is used for operating the conveyors and the crushing means, and may be sophisticated. Thus the control system may be adapted so that it automatically stops the feed conveyor when the signal is received from the metal detector. Further automation of the movement of the feed conveyor between the normal operating position and bypass position may be possible, but normally the operator will control these movements.

Another feature of a cone crusher is that it is more efficient and produces more evenly-sized crushed material, if the proportion of material that will pass through it without being crushed (commonly known as fines) is limited. One method of limiting the proportion of fines is to screen them out of the material before it is fed to the crusher. Currently, this requires a separate machine, which is expensive to buy (or hire) and to run. It also increases the time taken to process the material.

According to a second aspect of the invention, we provide a crushing machine comprising a feed conveyor, a screening unit, a crushing means and a main conveyor, the arrangement being such that material to be crushed is fed from the feed conveyor to the screening unit, for separation into finer material which reaches the main conveyor without passing through the crushing means, and coarser material which is fed in the crushing means to the main conveyor.

Thus, a single machine incorporates a screening function as well as a crushing function, enabling the finer material to be screened out and not to pass through the crushing means. This is particularly advantageous where the crushing means is a cone crusher. Providing both functions in one machine thus reduces costs, both capital costs and running costs, including transport costs.

The screening unit preferably comprises a screen conveyor and a vibrating mesh screen. Material from the feed conveyor is passed to the screen conveyor, from where it exits onto the mesh screen. Finer material falls through the screen, and onto the main conveyor, while the coarser material slides off the screen and into the crushing means. It will be appreciated that the screen must be angled to the horizontal for the coarser material to slide off it. The screening unit is therefore conveniently arranged on the opposite side of the crushing means from the feed conveyor.

The screening unit conveniently has a frame on which are mounted the screen and the screen conveyor. The frame is movable between an inoperative position, in which it is substantially horizontal, and an operative position, in which it is angled to the horizontal. The inoperative position is advantageous for transporting the machine. The screening unit may be moved between the two positions by at least one pair of hydraulic piston and cylinder assemblies, acting between a base off the machine and the screening unit. Preferably two pairs of assemblies are provided, one at each end of the screening unit. One pair acts vertically to lift the unit, while the other lifts and controls the angle of the unit.

The screen conveyor is conveniently mounted on the frame by a further pair of piston and cylinder assemblies. These enable the angle of the screen conveyor to be adjusted relative to the screen, and also enable the screen conveyor to be lifted relative to the screen, to facilitate changing of the screen.

BRIEF DESCRIPTION OF THE DRAWINGS

The two aspects of the invention are illustrated, by way of example only, in the accompanying drawings, in which.

DETAILED DESCRIPTION

Figure 1:
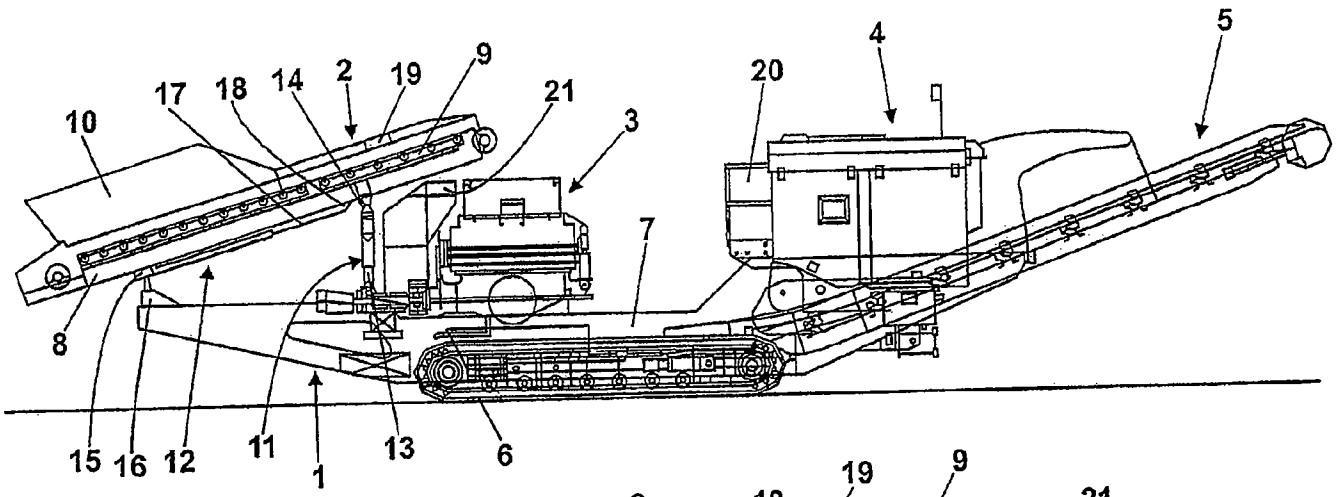
FIG. 1 is a side view of a mobile crushing machine in accordance with the first aspect of the invention and in a normal operating position.

The machine of FIG. 1 is a mobile crushing machine for crushing stone, aggregate and the like. The machine comprises a base 1, on which are mounted a feed conveyor 2, crushing means 3, a power unit 4 including a control unit, and a main conveyor 5.

The base 1 has tracks 6 and an elongate platform 7 on which the other parts are mounted. with the feed conveyor 2 at the rear end, and the main conveyor 5 at the front end.

The feed conveyor 2 is of a known design having a frame 8 for a powered belt 9 and a feed chute 10 at the rear end of the belt 9 to receive material to be crushed.

Figure 2:
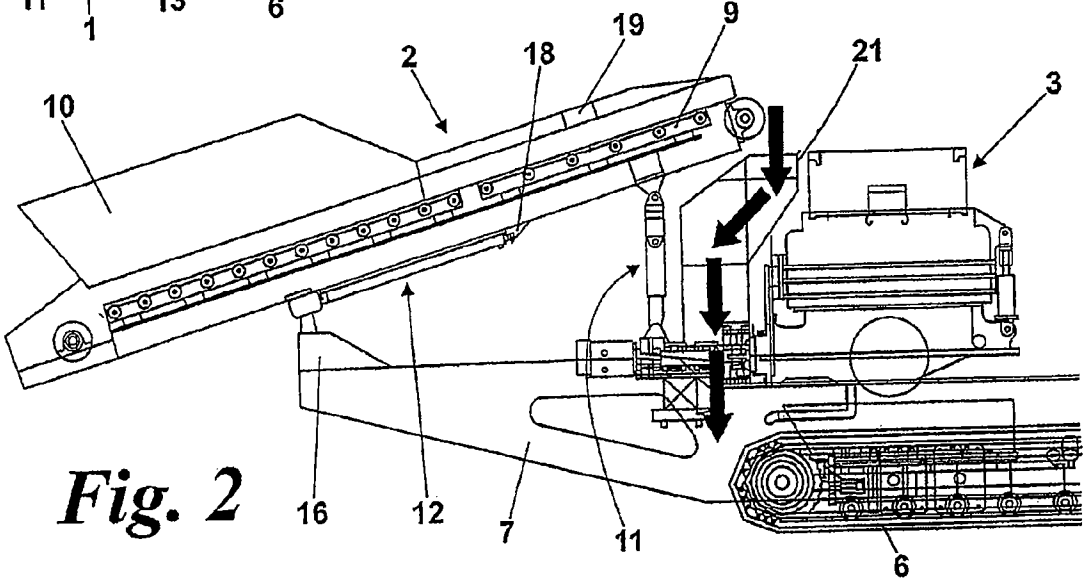
FIG. 2 is a detail of the machine of FIG. 1 showing the bypass position.

The frame 8 is mounted on the platform 7 by two pairs of hydraulic piston and cylinder assemblies 11, 12. The assemblies 11 act vertically to raise and lower the forward end of the frame 8 with the cylinders 13 being attached to the platform 7, and the pistons 14 pivotally mounted to the frame 8. The assemblies 12 act to move the frame 8 in the longitudinal direction between the normal operating position of FIG. 1, and a bypass position of FIG. 2. The cylinders 15 are pivotally attached to an upstand 16 on the platform 7, while the pistons 17 are connected to an abutment 18 on the underside of the frame 8. The piston and cylinder assemblies 11, 12 are double-acting, and have load-holding valves (not shown) to lock the pistons in any desired position. The feed conveyor 2 also carries a metal detector 19, mounted near the forward end of the belt, and adapted to send a signal to the control unit when metal is detected in the material on the feed conveyor 2.

The crushing means 3 comprises a cone crusher of known design, which need not be described further here. Material fed into the top of the crusher 3 from the forward end of the feed conveyor 2 is crushed, and falls out of the bottom of the crusher 3 onto the main conveyor 5.

The main conveyor 5, mounted on the front end of the platform 7, is also of a known design, and will not be described further here.

The power and control unit 4 is also mounted near the front end of the platform 7, and includes a diesel engine (not shown) as the power source for the machine, an hydraulic system (not shown) for operating the piston and cylinder assemblies 11, 12 and all other hydraulic components, and controls (not shown) for the machine. These are housed in a control area 20 for the machine operator. The controls include manual controls and electronic controls for automatically performing some operations.

A bypass chute 21 is mounted on the platform 7 between the feed conveyor 2 and the crusher 3. Material fed into the top of the chute 21 will not fall onto the main conveyor 5, but instead will be discharged to the side of the machine, to fall onto the ground, or into a suitable container.

FIG. 1 shows the machine in its normal operating position.

The feed conveyor 2 is raised by means of the assemblies 11, and the pistons 17 of the assemblies 12 are extended, so that the conveyor 2 is ready to discharge into the crusher 3. Then, in operation, material placed in the feed chute 10 is carried upwards by the feed conveyor 2, and discharged into the crusher 3. The crushed material falls out of the bottom of the crusher 3 onto the main conveyor 5, and is discharged at the forward end of that conveyor into a suitable container. The operator controls the conveyors 2, 5 and the crusher 3 from the control area 20.

If the metal detector detects the presence of metal in the material on the feed conveyor 2, it sends a signal to the electronic controls, which operate to stop the feed conveyor 2. The operator then actuates the assemblies 12, to retract the pistons 17, causing the feed conveyor 2 to move rearwardly into the bypass position shown in FIG. 2, where the material on the feed conveyor is discharged into the bypass chute 21, rather than the crusher 3. The operator then starts the feed conveyor 2 again, so that the material including the metal is discharged into the bypass chute to fall on the ground at the side of the machine. Once the operator is satisfied that the metal is no longer on the belt 9, he stops the conveyor 2 and actuates the assemblies 12 to extend the pistons 17 again, thus moving the feed conveyor 2 back into the normal operating position. The feed conveyor 2 can then be restarted, and normal operation resumed.

It will be appreciated that the machine is therefore able to deal with metal in the material quickly and easily, and without the operator needing to leave the control area 20.

Figure 3:
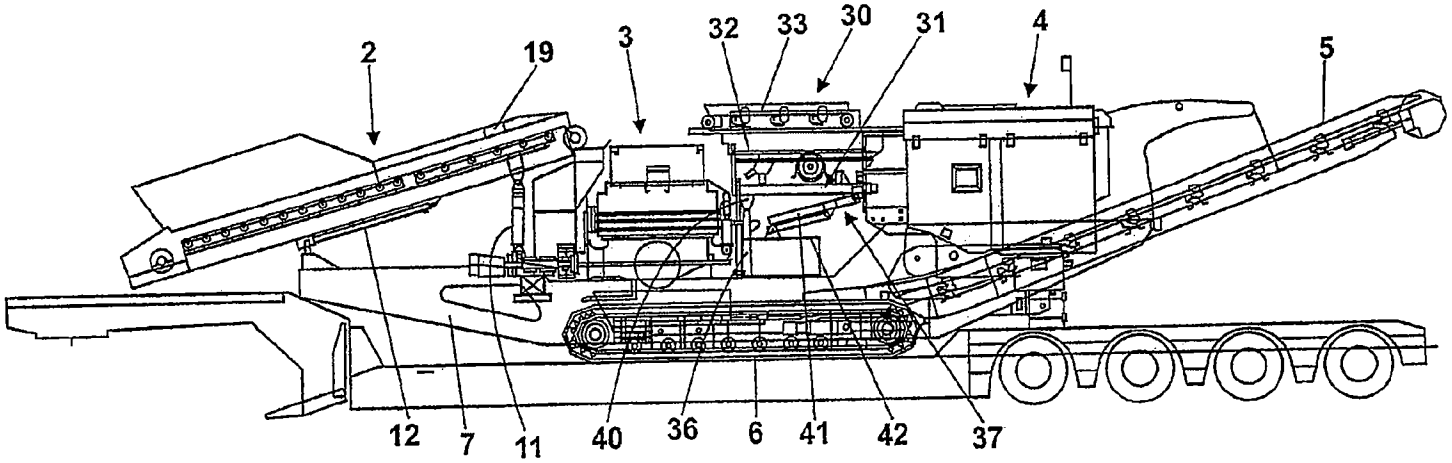
FIG. 3 is a side view of a mobile crushing machine which illustrates both aspects of the invention, and shows the machine in a transport position.

FIG. 3 shows the machine of FIG. 1 in a position in which it can be transported on a low loader or the like, and also illustrates the second aspect of the invention. In relation to the first aspect of the invention, however, it will be noted that for transport, the feed conveyor 2 is in the bypass position.

Figure 4:
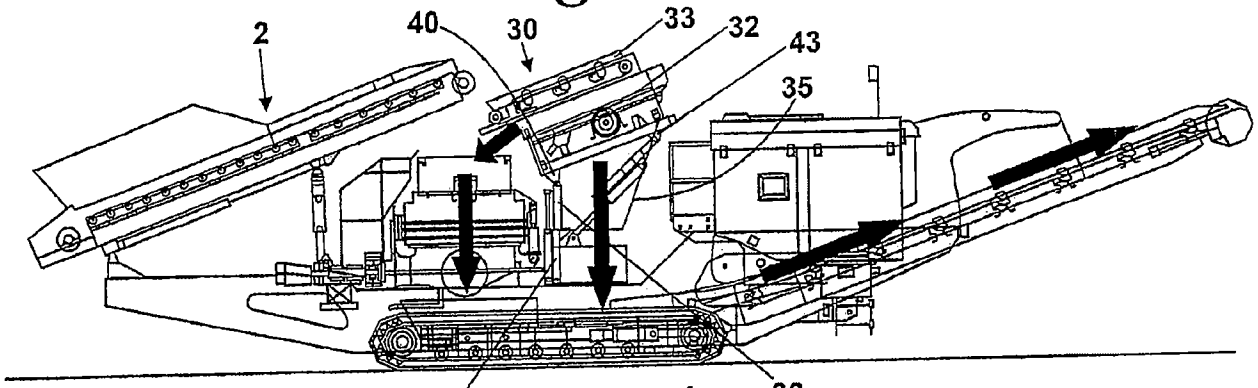
FIG. 4 is similar to FIG. 3, but shows the machine in an operating position.

The additional component of the machine shown in FIGS. 3 and 4 is a screening unit 30. The remainder of the machine is as shown in FIG. 1, and corresponding reference numerals have been applied to corresponding parts. Only the screening unit 30 will now be described.

Figure 5:
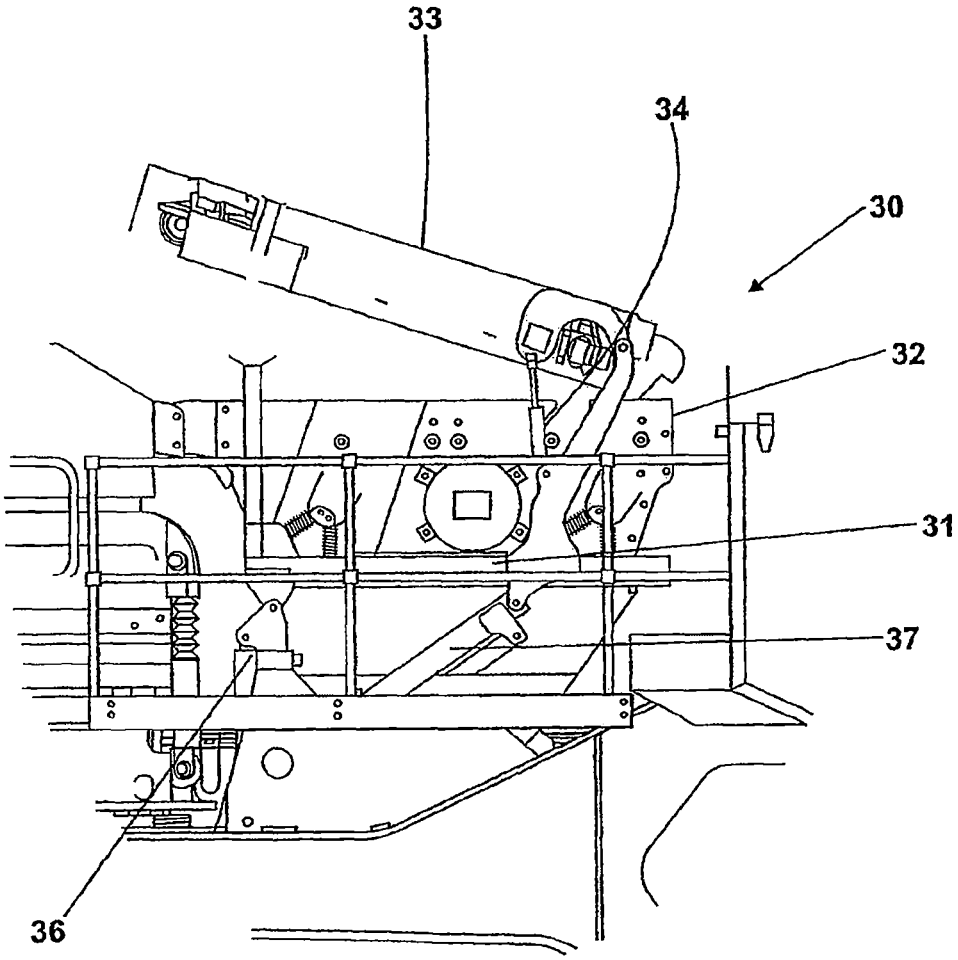
FIG. 5 shows a detail of the machine of FIGS. 3 and 4.

The screening unit 30 is mounted on the platform 7 between the crusher 3 and the control area 20. It comprises a rectangular frame 31 that carries a vibrating mesh screen 32 and a screen conveyor 33. The screen 32 is removably mounted in the frame 31, since different sizes of mesh may be needed to screen different materials. The screen conveyor 33 is located above the screen 32, and is mounted on the frame 31 by a pair of piston and cylinder assemblies 34. This is best seen in FIG. 5, which shows the detail of the screening unit 30. The cylinders of the assemblies 34 are attached to the frame 31, while the pistons are pivotally attached to the screen conveyor 33. Actuation of the assemblies 34 enables the angle of the screen conveyor 33 to be adjusted relative to the screen 32, to facilitate changing of the screen 32.

The screening unit 30 also has a chute 35, as shown in FIG. 4, for directing material passing through the screen 32 onto the main conveyor 5.

The frame 31 is mounted on the platform 7 by two further pairs of piston and cylinder assemblies 36, 37. The pair 36 is at the rear end of the frame 31, and acts vertically. The cylinders 38 of the assemblies 36 are attached to the platform 7, while the piston 39 is pivotally attached to a projection 40 at the rear of the frame 31. The assemblies 37 act at an angle on the front end of the frame 31. The cylinders 41 of the assemblies 37 are attached pivotally to a step 42 on the platform 7, and the pistons 43 are pivotally attached to the front end of the frame 31.

In FIG. 3 the screening unit 30 is in a horizontal position, for ease of transportation. FIG. 4 shows the machine in its normal operating position, with the screening unit 30 raised by the assemblies 36, 37, and the assemblies 34 extended to raise the screen conveyor 33 relative to the screen 32. The screening unit 30 is then at an angle to the horizontal. The rear end of the screen conveyor 33 is below the discharge point of the feed conveyor 2, while the discharge point at the front end is above the end of the screen 32. The rear, lower end of the screen 32 is above the top of the crusher 3.

Thus, in operation, material discharged from the feed conveyor 2 falls onto the screen conveyor 33, which in turn discharges it onto the vibrating screen 32. The finer material passes through the screen 32 and falls through the chute 35 onto the main conveyor 5, while the coarser material, which does not pass through the screen 32, slides or rolls down the screen 32 and into the crusher 3, crushed material, as in the embodiment for FIG. 1, then falls onto the main conveyor 5.

FIG. 5 shows how the screen 32 is changed. For this, with the screening unit 30 in its inoperative position, the operator actuates the assemblies 34 to extend the pistons, causing the screen conveyor 33 to be raised as shown. The operator can then easily reach the screen 32 to remove it and to insert a different screen. The assemblies 34 are then actuated to lower the screen conveyor 33 again, returning the unit 30 to its inoperative position.

The advantage of the screening unit 30 is that it limits the proportion of finer material that passes through the crusher 3, which then operates more efficiently. It will be appreciated that the advantages of including the screening unit 30 on the machine, rather than using a separate screening unit, are that capital and running costs (including transport costs) are reduced, as is set-up time. The time needed to change a screen is also minimized.

Clearly, the two aspects of the invention may be used independently. If they are both incorporated in one machine it will increase efficiency accordingly.

What we claim is:

1. An aggregate crushing machine comprising a base on which are mounted a crusher, a feed conveyor for feeding material comprising aggregate to the crusher, a detector for detecting metal in the material on the feed conveyor, and a bypass chute for the crusher, the feed conveyor being longitudinally movable between a normal operating position in which the material is fed to the crusher and a bypass position in which the material is fed to the bypass chute, the arrangement of the machine being such that on detection of metal in the material, the feed conveyor is equipped to be stopped and moved longitudinally from the normal operating position to the bypass position so that the material with the metal can be discharged into the bypass chute.

2. The machine according to claim 1 further comprising an arrangement such that once the material containing the metal has been discharged into the bypass chute, the feed conveyor can be stopped again, moved back into the normal operating position and started, to resume discharge into the crusher.

3. The machine according to claim 1 in which the metal detector is mounted on the feed conveyor.

4. The machine according to claim 1 in which the metal detector is arranged to send a signal to an operator when metal is detected.

5. The machine according to claim 1 in which the feed conveyor is movable between the operating position and the bypass position by operation of at least one of a hydraulic piston and cylinder assembly and a pneumatic piston and cylinder assembly.

6. The machine according to claim 1 further comprising an arrangement such that crushed material which exits the crusher will fall, in use, onto a main conveyor.

7. The machine according to claim 1 further comprising an arrangement such that the material discharged into the bypass chute can be diverted away from the crushed material.

8. The machine according to claim 1 in which the bypass chute moves rearwardly from the normal operating position to the bypass position.

9. The machine according to claim 1 further comprising a screening unit and a main conveyor, the arrangement of the machine being such that material to be crushed is fed from the feed conveyor to the screening unit, for separation into finer material which will be passed onto the main conveyor without passing through the crusher, and coarser material will be fed via the crushing means to the main conveyor.

10. The machine according to claim 9 in which the screening unit comprises a screen conveyor and a screen.

11. The machine according to claim 1 wherein the crusher comprises a cone crusher.

* * * * *